US006682446B2

(12) United States Patent
Bolin

(10) Patent No.: US 6,682,446 B2
(45) Date of Patent: Jan. 27, 2004

(54) RANGE ESTIMATOR

(76) Inventor: Darrin Bolin, 1700 N. Lamb, #217, Las Vegas, NV (US) 89115

( * ) Notice: Subject to any disclaimer, the term of this patent is extended or adjusted under 35 U.S.C. 154(b) by 12 days.

(21) Appl. No.: 09/953,828

(22) Filed: Sep. 11, 2001

(65) Prior Publication Data

US 2002/0128092 A1 Sep. 12, 2002

Related U.S. Application Data

(60) Provisional application No. 60/232,179, filed on Sep. 11, 2000.

(51) Int. Cl.[7] ..... A63B 69/00
(52) U.S. Cl. ..... 473/439; 473/199
(58) Field of Search ..... 473/109, 118, 473/131, 155, 156, 192, 199, 197, 225, 439, 407, 455, 451

(56) References Cited

U.S. PATENT DOCUMENTS

| | | | | |
|---|---|---|---|---|
| 4,029,315 A | | 6/1977 | Bon | |
| 4,545,576 A | | 10/1985 | Harris | |
| 4,675,816 A | | 6/1987 | Brandon et al. | |
| 4,858,922 A | | 8/1989 | Santavaci | |
| 5,092,602 A | | 3/1992 | Witler et al. | |
| 5,138,322 A | | 8/1992 | Nuttall | |
| 5,401,026 A | * | 3/1995 | Eccher et al. | 473/199 |
| 5,446,701 A | | 8/1995 | Utke et al. | |
| 5,486,002 A | | 1/1996 | Witler et al. | |
| 5,507,485 A | * | 4/1996 | Fisher | 473/407 |
| 5,509,650 A | | 4/1996 | MacDonald | |
| 5,820,496 A | | 10/1998 | Bergeron | |
| 5,926,780 A | | 7/1999 | Fox et al. | |
| 5,976,038 A | | 11/1999 | Orenstein et al. | |

* cited by examiner

*Primary Examiner*—Kim Nguyen
(74) *Attorney, Agent, or Firm*—Robert Ryan Morishita; Anderson & Morishita, LLC

(57) ABSTRACT

A device for estimating the range of a struck ball includes a backstop, at least one velocity measuring device, a data processor having a data structure communicating with the velocity measuring device, and a display communicating with the data processor. The range of a struck ball is estimated by measuring the velocity and departure angle, or alternatively, the horizontal and vertical velocities of a moving ball. The measurements are communicated to the data processor. The data processor calculates the range using formulae stored in the data structure or extrapolates the range from a database stored in the data structure. The range may be further manipulated to take account of environmental factors and factors unique to the player. The range is displayed at the display.

19 Claims, 5 Drawing Sheets

50
MEASURE INITIAL HORIZONTAL AND VERTICAL VELOCITY OF BALL
64
LOOK UP VELOCITIES IN DATABASE
66
EXTRAPOLATE RANGE FROM DATABASE
56
INPUT CONDITIONS
58
CALCULATE FACTORS
60
APPLY FACTORS TO EXTRAPOLATED RANGE
62
OUTPUT TO DISPLAY

RANGE ESTIMATOR

This application claims the benefit of provisional application No. 60/232,179 filed on Sep. 11, 2000.

FIELD OF THE INVENTION

The present invention relates to devices for estimating the range of a struck ball. Specifically the present device utilizes velocity measurements to estimate the range of a ball, such as a football.

BACKGROUND OF THE INVENTION

Heretofore, many devices have been made that measure the speed of a ball. For example, radar devices are frequently used to measure the speed of a pitched baseball or a served tennis ball. Such devices are useful for training as well as measuring performance during competition. However, for football, soccer, rugby, and other similar sports, it is desirable to measure range rather than speed. For example, in football, the ability to estimate the distance a kicker will kick a football could be critical to winning a game. There are, however, no devices in the prior art that can be used to estimate the range of a larger ball, such as a football, soccer ball, or the like, by accounting for all the relevant factors that will affect the range.

For example, U.S. Pat. No. 4,858,922 to Santavaci discloses a cage having velocity sensing devices to sense the speed of a struck golf ball. A display displays either the speed of the ball or an estimated distance based on an assumed entry angle. The drawback to such a system is that because the entry angle is assumed, variations in the range caused by trajectory are ignored. While the effect of the entry angle may be negligible for balls with low mass and low volume, such as golf balls, the entry angle effect often cannot be neglected for balls with larger mass and larger volume, such as footballs and soccer balls. Moreover, the device of Santavaci does not include a means for varying the range estimate based on the user and environmental conditions. While factors unique to the user and the environmental conditions, such as wind speed and direction, may be negligible for golf balls, such factors can affect the range of larger balls.

Likewise, U.S. Pat. No. 5,092,602 to Witler et al. discloses a golfing apparatus for estimating the range of a golf ball. Again, however, the device of Witler is uniquely adapted for golf by using the ball speed and a weighting factor based on the golf club to estimate the range. The drawback is that in the preferred embodiment, the entry angle is not measured but built into the weighting factor based on the club used. Thus, inaccuracies may occur in the estimated range.

It can be seen that there is a need in the art for a device that may be used to estimate the range of a moving ball.

SUMMARY OF THE INVENTION

The present invention includes a backstop, optionally a net mounted on a frame. The invention further includes at least one velocity measuring device, such as a radar gun. The velocity measuring device communicates with a data processor having at least one data structure. The data processor also communicates with a display. In one optional embodiment, the processor receives at least a velocity signal and a trajectory signal from the velocity measuring device. Alternatively, the data processor may receive at least a horizontal velocity signal and a vertical velocity signal from the velocity measuring device. Based on these measurements, the data processor calculates the range of the ball using equations known in the art that are stored in the data structure. The data processor displays the calculated range at the display.

In an alternate embodiment, the data structure stores a database storing velocity, trajectory, and associated range data, or alternatively horizontal velocity, vertical velocity, and associated range data. Upon receiving the speed and trajectory measurements, or in an alternate optional embodiment the horizontal speed and vertical velocity measurements, the processor extrapolates from the database an estimated range.

The data processor additionally communicates with an input device that allows the user to input at least one environmental condition. The data processor factors the environmental condition into the estimated range. Additionally, in an optional embodiment, the data processor may allow input of a weighting factor to account for unique user characteristics.

It is an object of the present invention to provide a device for measuring the velocity of a struck ball and estimating the range of the ball based on the measurements.

DESCRIPTION

Figure 1:
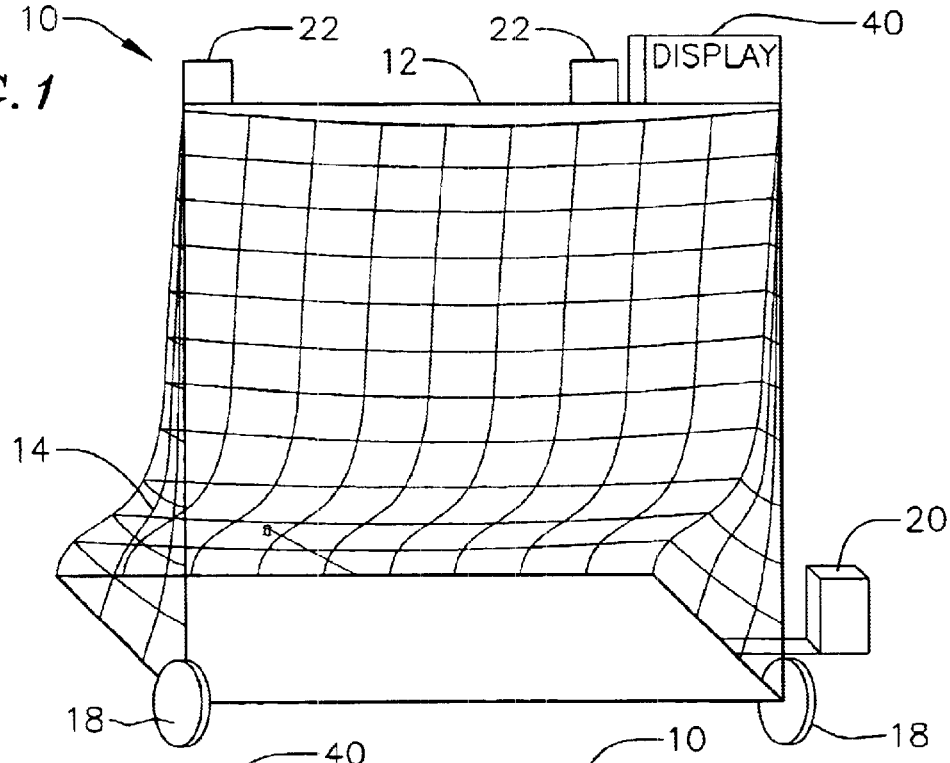
FIG. 1 is a front view of the device according to an embodiment of the present invention.
Figure 2:
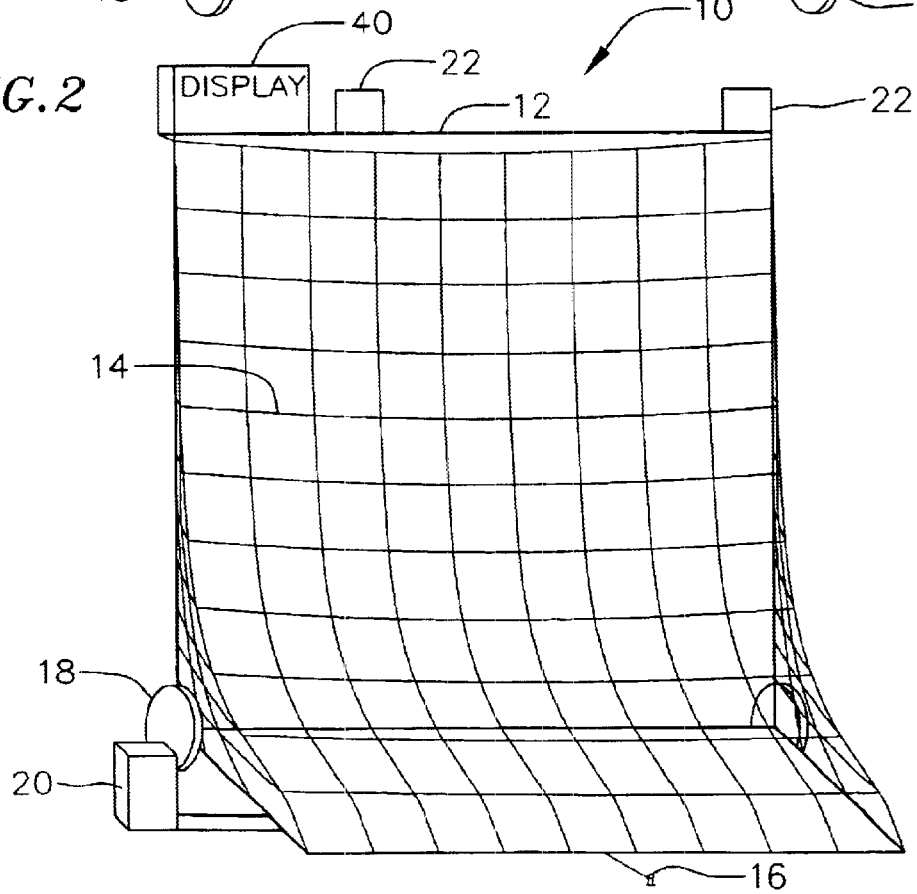
FIG. 2 is a back view of the device according to an embodiment of the present invention.

Reference is now made to the figures wherein like parts are referred to by like numerals throughout. With reference to FIGS. 1 and 2, the present invention includes a backstop 10. In the optional embodiment of FIGS. 1 and 2, the backstop 10 includes a net 14 held in place by a frame 12. Optionally, the backstop 10 may be anchored, such as with a stake 16. In a further optional embodiment, the backstop 10 may include wheels 18 to facilitate portability.

The invention includes at least one velocity measuring device 22. Optionally, two or more velocity measuring devices 22 may be used. In the embodiment of FIGS. 1 and 2, two velocity measuring devices 22 are used with each mounted at one side of the backstop 10.

It is contemplated that the velocity measuring devices 22 could take a variety of forms. For example, the velocity measuring devices 22 could be conventional radar guns known in the art that emit an electromagnetic signal and measure the responses of the electromagnetic signal reflective off the moving object. Alternatively, the velocity measuring device 22 could include velocity sensing means that utilize visible light, infrared light, ultraviolet light, laser light, electromagnetic radiation, ultrasound, or the like.

Figure 3:
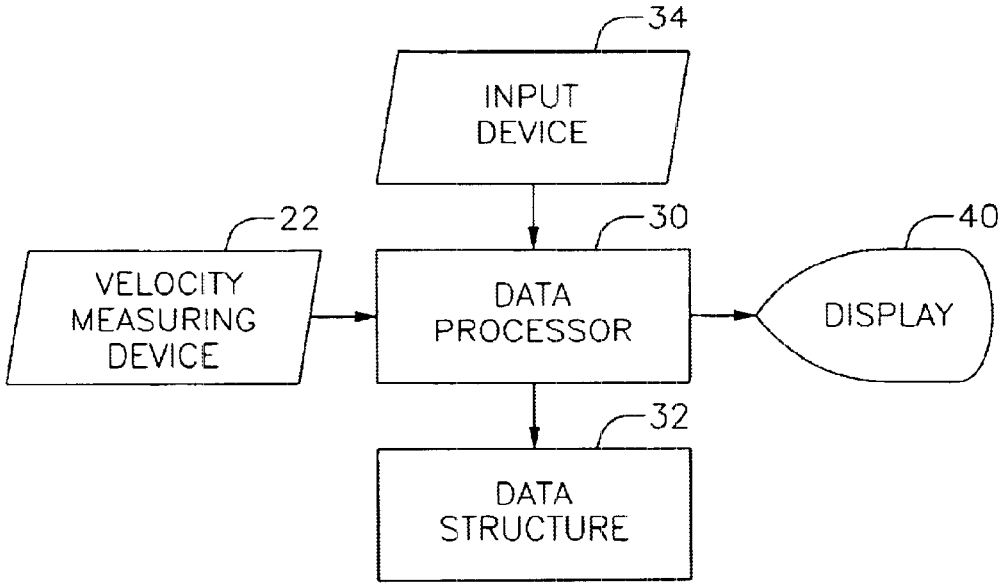
FIG. 3 is a block diagram of the device according to an embodiment of the present invention.

As shown in FIG. 3, the velocity measuring devices 22 communicate with a data processor 30 having at least one data structure 32. The data processor 30, in turn, communicates with a display 40.

The data processor 30 and data structure 32 could be of any type known in the art. For example, the data processor 30 could be a microprocessor 30 readily available and the data structure 32 could be read-only memory ("ROM"), random access memory ("RAM"), electrically programmable read-only memory ("EPROM"), electrically alterable read-only memory ("EAROM"), magnetic storage, or optical storage. The data structure 32 stores programming instructions and equations for the data processor 30 as well as any constants required in the calculations, such as the acceleration of gravity (g). In a further optional embodiment, described in more detail hereinafter, the data structure 32 may store a database of velocities and corresponding ranges.

Likewise, the display 40 could be of any type known in the art. For example, the display 40 could be a liquid crystal display ("LCD"), plasma display, digital readout, or the like.

As shown in FIG. 3, the data processor 30 may additionally communicate with an input device 34. This input device 34 could be of any type contemplated in the art such as a selector switch, keyboard, keypad, mouse, touchpad, or the like. The data processor 30, display 40, and velocity measuring devices 22 are powered by a power supply 20. Optionally, the power supply 20 is a battery to facilitate portability of the device.

In use, the backstop 10 is set up with the opening facing the player that will strike the ball. The backstop 10 allows the present invention to be used as a training device on, for example, a practice field, or on the sidelines as a means for practicing and estimating a player's performance during an actual game or match. Likewise, because the present invention is portable and self contained, the present invention could be used as an entertainment device at a sports bar, arcade, or the like. As an example, use will be described for a kicker kicking a football. This example, however, should not be construed as limiting the scope of the present invention. Indeed, the present invention could be used for any struck ball for which a range (R) or carry distance is desired.

Figure 4:
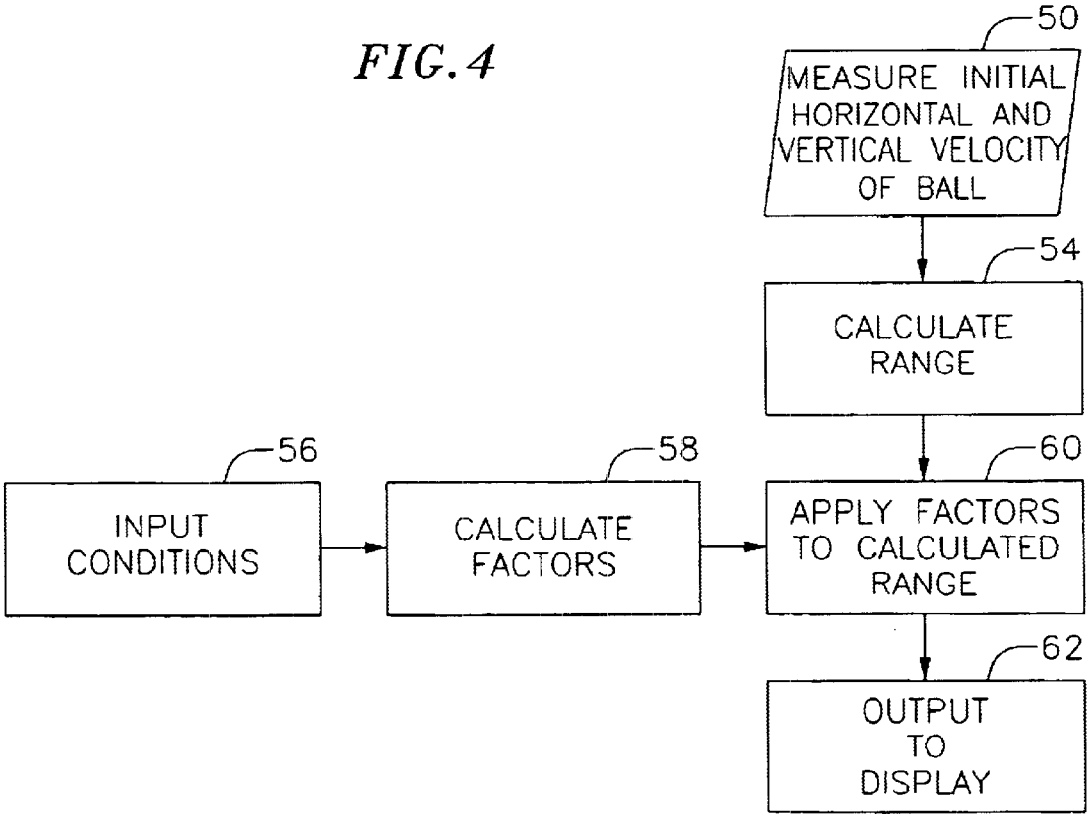
FIG. 4 is a flow chart of an embodiment of the method of the present invention.
Figure 5:
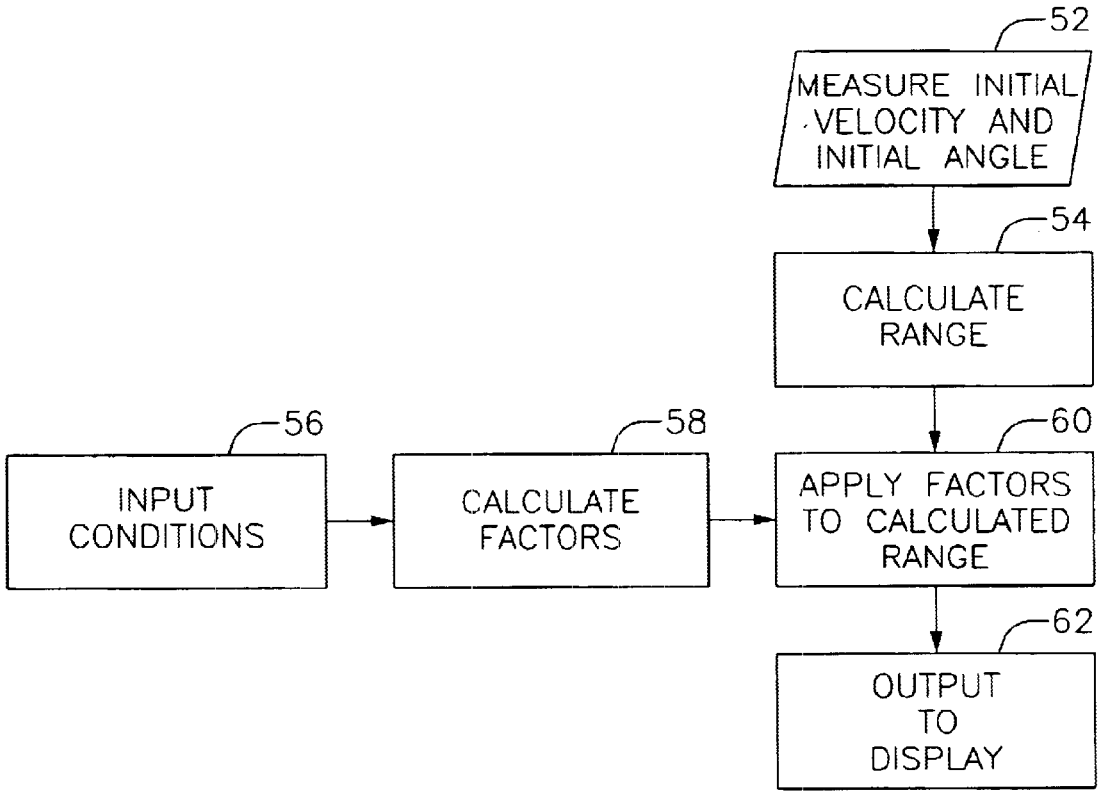
FIG. 5 is a flow chart of an alternate embodiment of the method of the present invention.

The ball is set up in front of the frame 12 and the ball is kicked into the backstop 10. As shown in FIG. 5, in one optional embodiment, as the ball moves, the velocity measuring device 22 or devices 22 measure 50 the initial velocity ($v_0$) and the departure angle ($\theta_0$) of the ball. In an alternate embodiment, shown in FIG. 4, the velocity measuring device 22 or devices 22 measure 50 the horizontal velocity ($v_{x0}$)and vertical velocity ($v_{y0}$) of the ball. With reference to FIGS. 4 and 5, the velocity ($v_0$) and departure angle ($\theta_0$) measurements or, in the alternate embodiment, the horizontal velocity ($v_{x0}$) and vertical velocity ($v_{y0}$) measurements, are communicated from the velocity measuring device 22 to the data processor 30. The range (R), i.e. the distance the ball will travel before striking the ground or, alternatively, passing through a set of uprights, is then calculated 54 by the data processor 30. Specifically, as shown in FIG. 4, in the embodiment in which initial horizontal velocity ($v_{x0}$) and initial vertical velocity ($v_{y0}$) are measured, range (R) is given by the following equation:

$$R = \frac{2v_{x0}v_{y0}}{g}$$

where g is the acceleration of gravity. In an alternate embodiment, shown in FIG. 5, in which initial velocity ($v_0$) and departure angle ($\theta_0$) are measured, range (R) is given by:

$$R = \frac{v_0^2 \sin 2\theta_0}{g}$$

where g is the acceleration of gravity.

Referring again to FIGS. 4 and 5, in the example of football, however, a kicked football must pass over the crossbar of a goal post. The crossbar is ten feet above the ground. In this situation, the flight time (t) must first be calculated according to the following equation:

$$h = v_{y0}t - \tfrac{1}{2}gt^2$$

where h is the height of the crossbar, i.e. ten feet, $v_{y0}$ is the initial vertical velocity, and g is the acceleration of gravity. Using the flight time (t), the range (R) is calculated as follows:

$$R = v_{x0}t$$

where $v_{x0}$ is the initial horizontal velocity. When initial velocity ($v_0$) and departure angle ($\theta_0$) are measured, the following equations may be used to calculate the initial horizontal velocity ($v_{x0}$) and initial vertical velocity ($v_{y0}$):

$$v_{x0} = v_0 \cos \theta_0$$

$$v_{y0} = v_0 \sin \theta_0$$

Figure 6:
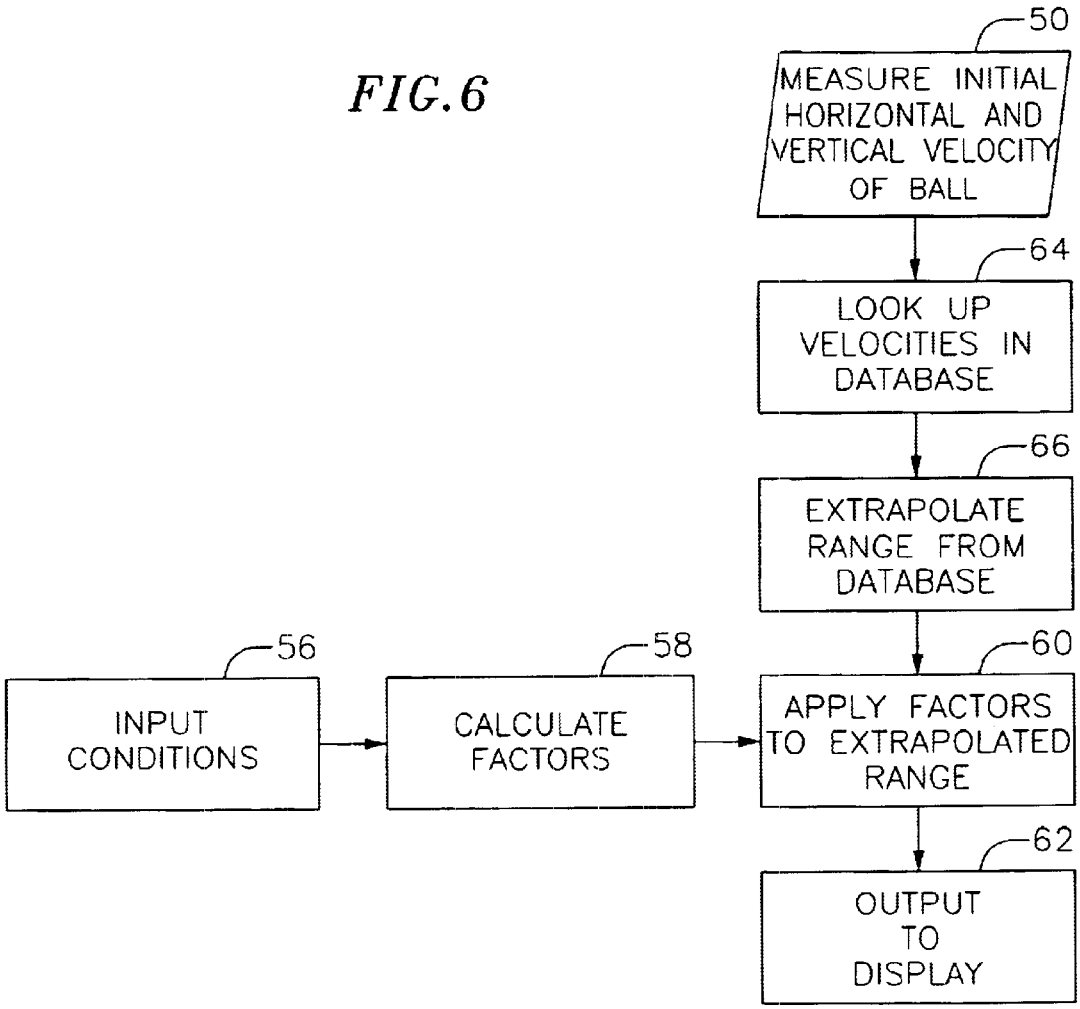
FIG. 6 is a flow chart of an alternate embodiment of the method of the present invention.
Figure 7:
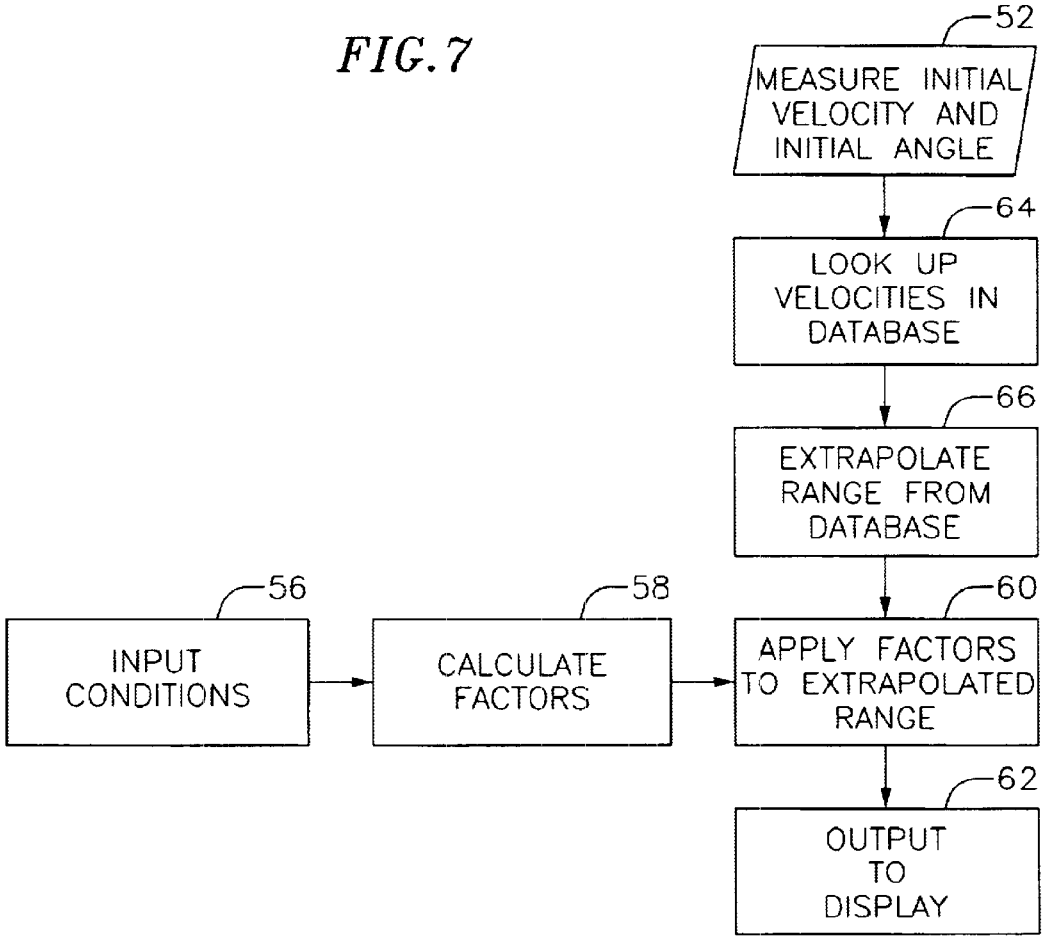
FIG. 7 is a flow chart of an alternate embodiment of the method of the present invention.

In an alternate embodiment, shown in FIGS. 6 and 7, rather than calculating 54 the range (R), the range (R) may be extrapolated 66 from a database of velocity-range data. In such an embodiment, a database is built using the equations above or empirically by measuring velocity and range for a particular kicker and entering the measurements into the database. In either case, the database generated is stored in a data structure 32 communicating with the data processor 30. For example, a database could look like that shown in Table 1.

TABLE 1

| Velocity | Departure Angle | Range |
|---|---|---|
| 40 m.p.h. | 30° | 30 yards |
| 50 m.p.h. | 30° | 45 yards |
| 60 m.p.h. | 30° | 65 yards |

In the present example, if a kicker is consistently kicking at fifty-five miles per hour at an angle of thirty degrees on a particular day, the data processor 30 would look up 64 the measured velocity in the database and, in this example, return a range of between forty-five and sixty-five yards. More specifically, the data processor 30 could use any of a number of extrapolation techniques 66 known in the art to narrow the projected range (R). For example, using linear extrapolation, a velocity ($v_0$) of fifty-five miles per hour would be expected to generate a range (R) of approximately fifty-five yards according to the above table.

With reference to FIGS. 4–7, regardless of how the range (R) is calculated 54 or extrapolated 66, in the further embodiment having an input device 34, the display 40 may display a range ($R_d$) that is calculated to take account of environmental conditions or the unique kicker. That is, factors unique to the kicker or the environmental conditions, such as wind, precipitation, temperature, altitude, or the like, may be input 56 using the input device 34 and accounted 60 for by the data processor 30 before displaying a range ($R_d$).

In such a situation, certain observable conditions, such as wind speed, temperature, and altitude, may be input 56 at the input device 34 and communicated to the data processor 30. Based on one or more of these input data, the data processor 30 may retrieve 58 from the data structure 32 an environmental factor (E) or, in an alternate embodiment, calculate 58 an environmental factor (E).

A kicker factor (K) could be determined in a similar way. For example, based on empirical testing, it may be determined that the range achieved by each kicker for a particular speed may differ. For this purpose, each kicker may be assigned a kicker factor (K). The kicker factors (K) may be stored in the data structure 32 or, alternatively, input using the input device 34. Utilizing these factors and the calculated range (R), the displayed range ($R_d$) may be calculated 60 using the following equation:

$$R_{d-EKR}$$

where E is a factor relating to environmental conditions and K is a factor relating to factors unique to the kicker. For example, an average kicker with a kicker factor (K) equal to one kicking under ideal conditions, i.e. an environmental factor (E) of one, would have a displayed range ($R_d$) equal to the calculated range (R). Conversely, the same kicker kicking into a strong wind, i.e. an environmental factor (E) less than one, would have a displayed range ($R_d$) less than the calculated range (R) because the wind would tend to reduce the actual range of the kick.

In a further optional embodiment, the environmental factor (E) could also take into account wind direction. In such an embodiment, the velocity measuring devices 22 would additionally measure the path of the ball. For example, one way that this could be accomplished is by measuring the differences between the measurements of each velocity measuring device. That is, a ball traveling on a straight path between the velocity measuring devices 22 would give equal readings on each velocity measuring devices 22. However, if the ball is not traveling perpendicular to the backstop 10, the velocity measuring devices 22 will register slightly different velocities. In such a case, the difference will give the deviation of the ball from a straight path.

When wind direction is factored into the environmental factor (E), the effects of the wind speed and direction may be used to calculate a proper path for the ball to pass between the goal posts. This proper path could then be displayed along with the range ($R_d$) to tell the kicker where to aim to counteract the effects of the wind or the estimated path that a kick in a particular direction would travel under the conditions input.

Once a range (R) or, in an alternate embodiment, a display range ($R_d$) is determined, it is output to a display 40.

While certain embodiments of the present invention have been shown and described, it is to be understood that the present invention is subject to many modifications and changes without departing from the spirit and scope of the description presented herein.

I claim:

1. A device for displaying the range of a struck ball comprising:

a backstop;

a velocity measuring device directed to measure the velocity and trajectory of a ball traveling toward the backstop;

a processor including a data structure, the processor communicating with the velocity measuring device to calculate a projected range based on the velocity and trajectory measured;

an input device communicating with said processor receiving input including at least an environmental factor, said processor calculating a display range based on the input and the projected range, said display range corresponding to a prediction of the range said ball would have traveled under the velocity and trajectory measured influenced by the environmental factor input; and a display displaying the display range.

2. The device of claim 1 wherein the environmental factor includes wind speed and direction.

3. The device of claim 1 wherein the environmental factor includes air temperature.

4. The device of claim 1 wherein the environmental factor includes humidity.

5. The device of claim 1 wherein the environmental factor includes altitude.

6. The device of claim 1 wherein the input further includes an empirical kicker factor.

7. The device of claim 1 further comprising a second velocity measuring device communicating with the processor spaced from said velocity measuring device measuring the velocity of the struck ball concurrent with said velocity measuring device, said processor calculating the direction of said traveling ball based on the difference in velocities measured between the two velocity measuring devices, said processor calculating a display direction based on the input and the calculated direction, said display direction corresponding to a prediction of the direction said ball would have traveled under the direction measured influenced by the environmental factor input.

8. A device for displaying the range of a struck ball comprising:

a backstop;

a velocity measuring device directed to measure the velocity and trajectory of a ball traveling toward the backstop;

a second velocity measuring device spaced from said velocity measuring device measuring the velocity and trajectory of said traveling ball concurrent with said velocity measuring device;

a processor including a data structure, the processor communicating with the velocity measuring device and said second velocity measuring device to extrapolate a projected range using a database of velocity-range data stored in said data structure based on the velocity and trajectory measured, said processor calculating the direction of said traveling ball based on the difference in velocities measured between the two velocity measuring devices;

an input device communicating with said processor receiving input including at least an environmental factor, said processor calculating a display range and display direction based on the input, the calculated direction, and the projected range, said display range and display direction corresponding to a prediction of the range and direction said ball would have traveled under the velocity, trajectory, and direction measured influenced by the environmental factor input; and a display displaying the display range.

9. The device of claim 8 wherein the environmental factor includes wind speed and direction.

10. The device of claim 8 wherein the environmental factor includes air temperature.

11. The device of claim 8 wherein the environmental factor includes humidity.

12. The device of claim 8 wherein the environmental factor includes altitude.

13. The device of claim 8 wherein the input further includes an empirical kicker factor.

14. A device for displaying the range of a struck ball comprising:

a backstop;

a velocity measuring device directed to measure the velocity and trajectory of a ball traveling toward the backstop;

a second velocity measuring device spaced from said velocity measuring device measuring the velocity and trajectory of said traveling ball concurrent with said velocity measuring device;

a processor including a data structure, the processor communicating with the velocity measuring device and said second velocity measuring device to calculate a projected range based on the velocity and trajectory measured, said processor calculating the direction of said traveling ball based on the difference in velocities measured between the two velocity measuring devices;

an input device communicating with said processor receiving input including at least an environmental factor and an empirical kicker factor, said processor calculating a display range and display direction based on the input, the calculated direction, and the projected range, said display range and display direction corresponding to a prediction of the range and direction said ball would have traveled under the velocity, trajectory, and direction measured influenced by the environmental factor input; and a display displaying the display range.

15. The device of claim 14 wherein the environmental factor includes wind speed and direction.

16. The device of claim 14 wherein the environmental factor includes air temperature.

17. The device of claim 14 wherein the environmental factor includes humidity.

18. The device of claim 14 wherein the environmental factor includes altitude.

19. The device of claim 14 wherein the input further includes an empirical kicker factor.

* * * * *